US006952908B2

(12) United States Patent
Spatafora et al.

(10) Patent No.: US 6,952,908 B2
(45) Date of Patent: Oct. 11, 2005

(54) TAMPON PACKING METHOD AND MACHINE

(75) Inventors: Mario Spatafora, Bologna (IT); Luca Borderi, Sasso Marconi (IT)

(73) Assignee: G.D. Societa per Azioni, Bologna (IT)

( * ) Notice: Subject to any disclaimer, the term of this patent is extended or adjusted under 35 U.S.C. 154(b) by 0 days.

(21) Appl. No.: 10/842,834

(22) Filed: May 11, 2004

(65) Prior Publication Data

US 2005/0011164 A1 Jan. 20, 2005

(30) Foreign Application Priority Data

May 13, 2003 (IT) ..... BO2003A0289

(51) Int. Cl.[7] ..... B65B 9/10
(52) U.S. Cl. ..... 53/456; 53/575
(58) Field of Search ..... 53/465, 210, 575, 53/456, 585

(56) References Cited

U.S. PATENT DOCUMENTS 1,792,203 A * 2/1931 Wakefield ..... 53/575
2,281,582 A * 5/1942 Irmscher ..... 53/575
2,580,456 A 1/1952 Noe
2,652,670 A 9/1953 Carrier
3,296,772 A 1/1967 Barker
3,856,143 A 12/1974 Simon et al.
4,617,781 A 10/1986 Ingersoll et al.
5,442,897 A * 8/1995 Hinzmann et al. ..... 53/452
2003/0233813 A1 * 12/2003 Leslie et al. ..... 53/452

FOREIGN PATENT DOCUMENTS

EP 0711705 A2 5/1996

* cited by examiner

*Primary Examiner*—Stephen F. Gerrity
(74) *Attorney, Agent, or Firm*—Jeffrey M. Kaden; Gottlieb, Rackman & Reisman, P.C.

(57) ABSTRACT

A method and machine for packing a tampon, whereby the tampon is inserted inside a tubular folding spindle of constant cross section; a sheet of packing material is then wrapped about the folding spindle and stabilized longitudinally to form a tubular wrapping; the folding spindle and the tubular wrapping, together with the tampon, are then parted; and the two ends of the tubular wrapping are closed transversely about the relative tampon.

24 Claims, 2 Drawing Sheets

TAMPON PACKING METHOD AND MACHINE

The present invention relates to a tampon packing method and machine.

BACKGROUND OF THE INVENTION

In tampon packing, it is fairly difficult to produce individually packed tampons, on account of the relatively delicate nature of the tampons, and the fact that they normally comprise two coaxial, substantially cylindrical portions with cross sections of different shapes and/or sizes. As a result, known tampon packing machines have a high potential for damaging the tampons during packing and/or producing flawed, unsightly packages.

SUMMARY OF THE INVENTION

It is an object of the present invention to provide a tampon packing method and machine designed to eliminate the aforementioned drawbacks, and which, at the same time, are cheap and easy to implement and produce.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
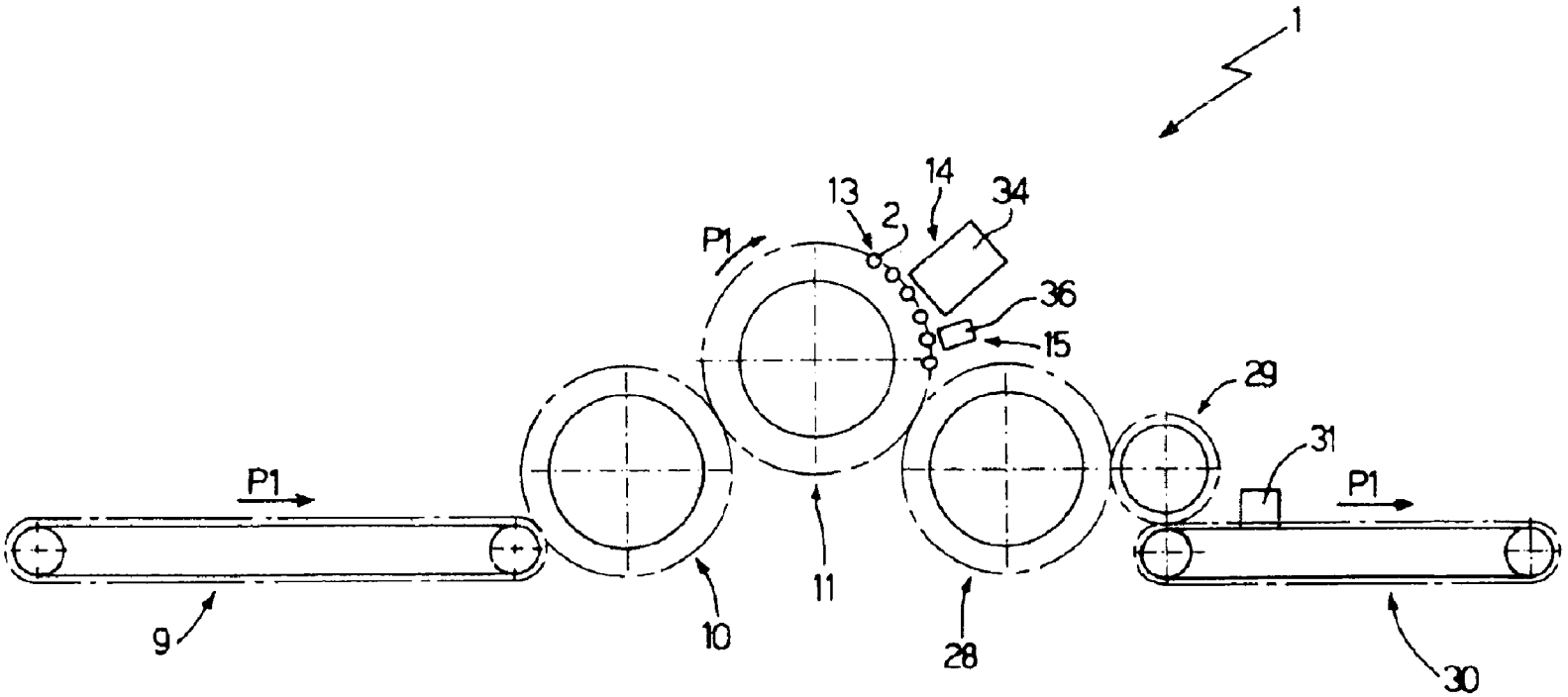
FIG. 1 shows a schematic side view of a machine in accordance with the present invention.

Number 1 in FIG. 1 indicates as a whole a machine for packing tampons 2.

Figure 2:
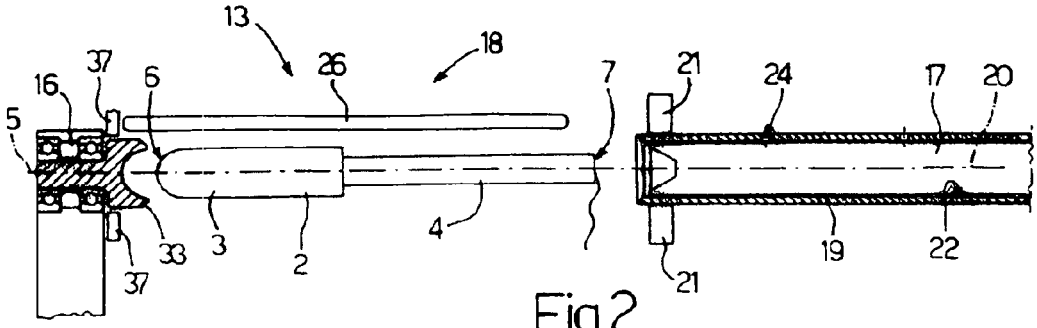
FIGS. 2, 3 and 4 show a section of a detail of the FIG. 1 machine in successive operating positions.
Figure 3:
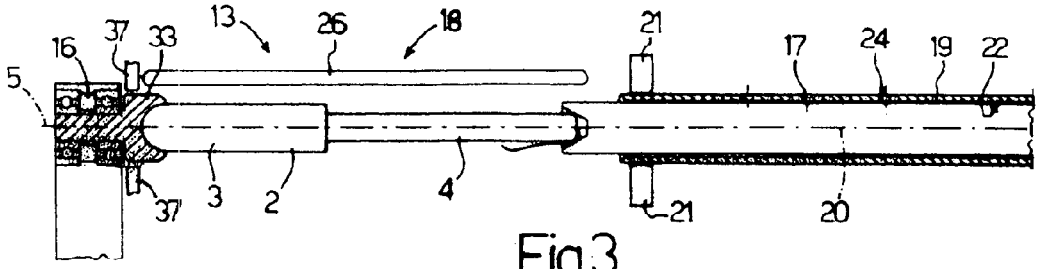
Figure 4:
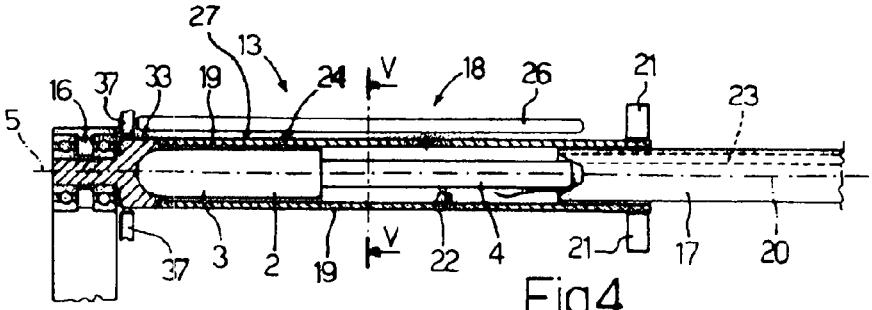

With reference to FIGS. 2, 3 and 4, each tampon 2 comprises two substantially cylindrical portions 3 and 4 having a substantially coincident longitudinal axis 5. Each portion 3, 4 has a respective substantially circular cross section having a respective diameter. In particular, the cross section diameter of portion 3 is greater than the diameter of portion 4. And each tampon 2 is bounded transversely by two ends 6 and 7.

With reference to FIG. 1, machine 1 packs each tampon 2 in a respective individual, substantially rectangular sheet 8 of packing material (FIG. 5) as tampon 2 is fed transversely along a feed path P1.

Machine 1 comprises a linear input conveyor 9, and a transfer wheel 10 for transferring tampons 2 from linear conveyor 9 to a packing wheel 11 located immediately downstream from transfer wheel 10 and for forming a tubular wrapping 12 (FIG. 6) about a respective tampon 2.

Packing wheel 11 comprises a number of peripheral seats 13, each for housing a respective tampon 2, and for conveying tampon 2 through a feed station 14, where a sheet 8 of packing material is fed to respective seat 13, and through a sealing station 15, where each sheet 8 of packing material is sealed to form tubular wrapping 12.

Each seat 13 comprises two clamping members 16 and 17, which engage ends 6 and 7 to clamp respective tampon 2 inside seat 13.

A folding assembly 18 is located at each seat 13, and comprises a respective folding spindle 19, which is substantially cylindrical with a circular base, and has a longitudinal axis 20 substantially coincident with axis 5 of tampon 2 when tampon 2 is housed inside seat 13. Each folding assembly 18 also comprises a respective actuating device 21 for moving relative folding spindle 19, in a direction parallel to axis 20, between a rest position (FIGS. 2 and 3) and a work position (FIG. 4), in which folding spindle 19 surrounds tampon 2, and for rotating spindle 19 about axis 20 to wrap respective sheet 8 about spindle 19.

Each folding spindle 19 has an inner chamber 22, which is substantially cylindrical with a circular base, and in which, in use, a vacuum is formed by a respective known suction conduit 23 (shown partly in FIGS. 2 to 5). Each folding spindle 19 also has a number of radial holes 24, which are arranged in a line substantially parallel to axis 20, connect chamber 22 with the outside, and provide for holding a longitudinal portion 25 of sheet 8 of packing material by suction on an outer surface of folding spindle 19.

With reference to FIGS. 2 to 6, each seat 13 also comprises a respective slide bar 26 extending parallel to axis 20 and defining, in use, together with folding spindle 19, a gap 27 through which sheet 8 of packing material slides as it is being wrapped about folding spindle 19.

Machine 1 also comprises two transfer wheels 28 and 29 for receiving each tubular wrapping 12, containing a respective tampon 2, from packing wheel 11, and for feeding tubular wrapping 12 to an output conveyor 30.

Figure 7:
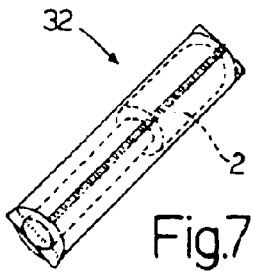
FIG. 7 shows a package produced on the FIG. 1 machine.

Machine 1 also comprises a sealing assembly 31 located at output conveyor 30 or, in an alternative embodiment not shown, at transfer wheel 29, and which provides for transversely sealing the ends of tubular wrapping 12 to form a package 32 (FIG. 7) containing tampon 2.

For the sake of simplicity, operation of machine 1 will now be described with reference to one tampon 2, and as of the instant in which tampon 2 is fed by transfer wheel 10 to packing wheel 11.

As shown in FIGS. 2 and 3, as tampon 2 engages respective seat 13, clamping members 16 and 17 are moved towards each other to engage respective ends 6 and 7 and so clamp tampon 2 inside seat 13.

At this point, folding spindle 19 is moved from the rest position to the work position (FIG. 4), in which one end of spindle 19 engages in fluidtight manner a rotary head 33—designed to rotate about axis 20—of clamping member 16, so that, when folding spindle 19 is set correctly in the work position, chamber 22 is defined in fluidtight manner by rotary head 33 at the front and by clamping member 17 at the rear.

At this point, as tampon 2 is being fed to feed station 14, a vacuum is formed inside chamber 22 by suction conduit 23, and produces suction through holes 24, so that portion 25 of a sheet 8 of packing material, fed to seat 13 by a feed unit 34 at feed station 14, adheres to the outer surface of folding spindle 19.

Figure 5:
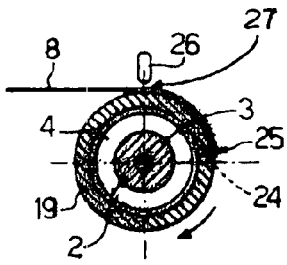
FIGS. 5 and 6 show a section along line V—V of the FIG. 4 detail in successive operating positions.
Figure 6:
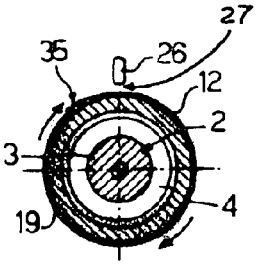

As shown in FIGS. 5 and 6, once portion 25 is positioned correctly on folding spindle 19, actuating device 21 is operated, and spindle 19 rotates at least 360° about axis 20, so that sheet 8 of packing material is wrapped about spindle 19, and a further portion 35, substantially parallel to portion 25, of sheet 8 of packing material is superimposed on portion 25.

At this point, a sealing unit 36 at sealing station 15 seals portion 35 to portion 25 to form tubular wrapping 12; after which, suction along suction conduit 23 is cut off, a gripper 37 cooperates with head 33 to grip tubular wrapping 12, and folding spindle 19 is withdrawn parallel to axis 20.

Clamping members 16 and 17 are then parted to release tampon 2 which, wrapped inside tubular wrapping 12, is then transferred to transfer wheels 28 and 29 and to output conveyor 30, where sealing assembly 31 seals the ends of tubular wrapping 12 transversely to form a package 32 containing tampon 2.

It should be stressed that, given the substantially constant cross section of folding spindle 19, machine 1 provides for producing relatively attractive, good-quality packages 32.

What is claimed is:

1. A method of packing an elongated tampon (2); the method comprising a positioning step to insert the tampon (2) inside a tubular folding spindle (19) of substantially constant cross section; a wrapping step in which a sheet (8) of packing material is wrapped about the folding spindle (19); a stabilizing step in which the sheet (8) of wrapped packing material is stabilized longitudinally to form a tubular wrapping (12) having two open ends; a parting step in which the folding spindle (19) and the tubular wrapping (12) are parted; and a closing step in which the ends of the tubular wrapping (12) are closed transversely to form a package (32) containing the tampon (2).

2. A method as claimed in claim 1, wherein, during the wrapping step, a first portion (25) of the sheet (8) of packing material is maintained in contact with an outer surface of the folding spindle (19).

3. A method as claimed in claim 2, wherein said first portion (25) of the sheet (8) of packing material is maintained in contact with the outer surface of the folding spindle (19) by suction.

4. A method as claimed in claim 2, wherein, while the first portion (25) of the sheet (8) of packing material is maintained in contact with the outer surface of the folding spindle (19), the folding spindle (19) rotates about its own longitudinal axis (20).

5. A method as claimed in claim 4, wherein the folding spindle (19) rotates at least 360°, so that a second portion (35) of the sheet (8) of packing material is superimposed on said first portion (25).

6. A method as claimed in claim 5, wherein, during the stabilizing step, the second portion (35) is sealed to the first portion.

7. A method as claimed in claim 1, wherein the folding spindle (19) is substantially cylindrical with a circular base.

8. A method as claimed in claim 1, wherein, during said positioning step and said parting step, the folding spindle (19) is moved axially.

9. A method as claimed in claim 8, wherein, during the parting step, the tubular wrapping (12) is retained so as not to accompany the movement of the folding spindle (19).

10. A method as claimed in claim 1, wherein at least said positioning step, said wrapping step, and said parting step are performed with the tampon (2) housed inside a seat (13) on a packing wheel (11).

11. A method as claimed in claim 1, wherein at least said positioning step, said wrapping step, and said parting step are performed as the tampon (2) is conveyed transversely along a feed path (P1).

12. A method as claimed in claim 1, and comprising a clamping step wherein clamping members (16, 17) engage the ends (6, 7) of the tampon (2) to clamp the tampon (2) inside a seat (13) prior to said positioning step.

13. A machine for packing an elongated tampon (2), the machine (1) comprising a tubular folding spindle (19) of substantially constant cross section; positioning means (21) for moving the folding spindle (19) and the tampon (2) with respect to each other, so that the tampon (2) is inserted inside the folding spindle (19); folding means (18) for wrapping a sheet (8) of packing material about the folding spindle (19); stabilizing means (36) for longitudinally stabilizing the sheet (8) of packing material wrapped about the folding spindle (19), so as to form a tubular wrapping (12) having two open ends; parting means (21, 37) for detaching the folding spindle (19) from the tubular wrapping (12); and closing means (31) for closing the ends of the tubular wrapping transversely to form a package (32) containing the tampon (2).

14. A machine as claimed in claim 13, wherein the folding spindle (19) is substantially cylindrical with a circular base, and the positioning means (21) comprise an actuating device (21) for moving the folding spindle (19) axially.

15. A machine as claimed in claim 13, wherein the folding spindle (19) is defined by a substantially cylindrical outer surface; said folding means (18) comprising retaining means (24) for maintaining a first portion (25) of the sheet (8) of packing material in contact with the outer surface of the folding spindle (19).

16. A machine as claimed in claim 15, wherein said retaining means (24) comprise suction means (24).

17. A machine as claimed in claim 13, wherein the folding spindle has a longitudinal axis (20); said folding means (18) comprising rotation means (21) for rotating the folding spindle (19) about its longitudinal axis (20).

18. A machine as claimed in claim 17, wherein said rotation means (21) rotate the folding spindle (19) by at least 360°.

19. A machine as claimed in claim 13, wherein said stabilizing means (36) comprise sealing means (36).

20. A machine as claimed in claim 13, and comprising conveying means (9, 10, 11, 28, 29, 30) for conveying the tampon (2) transversely along a feed path (P1), along which are located the folding spindle (19), the positioning means (21), the folding means (18), the stabilizing means (36), the parting means (21, 37), and the closing means (31).

21. A machine as claimed in claim 20, wherein said conveying means (9, 10, 11, 28, 29, 30) comprise a seat (13), at which are located the folding spindle (19), the positioning means (21), the folding means (18), the stabilizing means (36), and the parting means (21, 37); said seat (13) comprising two clamping members (16, 17) which engage the ends (6, 7) of the tampon (2) to clamp the tampon (2) inside the seat (13).

22. A machine as claimed in claim 20, wherein said conveying means (9, 10, 11, 28, 29, 30) comprise a packing wheel (11) in turn comprising said seat (13).

23. A machine as claimed in claim 13, and comprising a slide bar (26) extending parallel to the folding spindle (19), and which, in use, defines, together with the folding spindle (19), a gap (27) through which the sheet (8) of packing material slides as the sheet (8) of packing material is wrapped about the folding spindle (19).

24. A machine as claimed in claim 13, wherein the parting means (21, 37) comprise holding means (37) for retaining the tubular wrapping (12) as, in use, the folding spindle (19) is detached from the tubular wrapping (12).

* * * * *

UNITED STATES PATENT AND TRADEMARK OFFICE

CERTIFICATE OF CORRECTION

PATENT NO. : 6,952,908 B2
APPLICATION NO. : 10/842834
DATED : October 11, 2005
INVENTOR(S) : Spatafora et al.

It is certified that error appears in the above-identified patent and that said Letters Patent is hereby corrected as shown below:

Title page, item (73):

Change "G.D. Societa per Azioni" to --G.D Societa per Azioni--

Signed and Sealed this

Nineteenth Day of December, 2006

JON W. DUDAS
*Director of the United States Patent and Trademark Office*